US005534401A

United States Patent [19]

Vargas et al.

[11] Patent Number: 5,534,401

[45] Date of Patent: Jul. 9, 1996

[54] RETOUCHABLE REVERSAL SILVER HALIDE PHOTOGRAPHIC ELEMENT WITH A PYRAZOLOAZOLE MAGENTA DYE-FORMING COUPLER

[75] Inventors: J. R. Vargas, Webster; John W. Harder, Rochester; Phillip D. Knight, Fairport; Paul A. Burns; Lynda D. Weber, both of Rochester, all of N.Y.

[73] Assignee: Eastman Kodak Company, Rochester, N.Y.

[21] Appl. No.: 396,836

[22] Filed: Mar. 1, 1995

Related U.S. Application Data

[60] Continuation-in-part of Ser. No. 154,839, Nov. 19, 1993, abandoned, which is a division of Ser. No. 872,473, Apr. 23, 1992, Pat. No. 5,296,337.

[51] Int. Cl.[6] ..... G03C 1/08; G03C 7/26; G03C 7/32

[52] U.S. Cl. ..... 430/558; 430/955

[58] Field of Search ..... 430/955, 558

[56] References Cited

U.S. PATENT DOCUMENTS

| | | | |
|---|---|---|---|
| 3,725,067 | 4/1973 | Bailey et al. | 430/558 |
| 4,152,336 | 5/1979 | Kuroki et al. | 260/340.9 |
| 4,548,899 | 10/1985 | Nakayama et al. | 430/558 |
| 4,764,605 | 8/1988 | Hanessian et al. | 536/124 |
| 4,990,430 | 2/1991 | Harder et al. | 430/359 |
| 5,019,492 | 5/1991 | Buchanan et al. | 430/543 |
| 5,021,325 | 6/1991 | Burns et al. | 430/387 |
| 5,051,343 | 9/1991 | Lestina et al. | 430/393 |
| 5,073,473 | 12/1991 | Koya et al. | 430/247 |
| 5,104,780 | 4/1992 | Sugita et al. | 430/543 |
| 5,118,594 | 6/1992 | Lesting et al. | 430/393 |
| 5,210,007 | 5/1993 | Texter et al. | 430/943 |
| 5,242,783 | 9/1993 | Buchanan et al. | 430/558 |
| 5,273,868 | 12/1993 | Sakurazawa et al. | 430/558 |
| 5,278,038 | 1/1994 | Miyoshi et al. | 430/558 |

FOREIGN PATENT DOCUMENTS

| | | |
|---|---|---|
| 0434148 | 6/1991 | European Pat. Off. . |
| 3423821 | 1/1986 | Germany . |
| 2072643 | 10/1981 | United Kingdom . |

OTHER PUBLICATIONS

Professional Photographer, Nov. 1989, vol. 116, No. 2130, pp. 44–48, by Donald McLeod.

Professional Photographer, Dec. 1989, vol. 116, No. 2131, pp. 30–34, by Donald McLeod.

*Primary Examiner*—Charles L. Bowers, Jr

*Assistant Examiner*—J. Pasterczyk

*Attorney, Agent, or Firm*—Joshua G. Levitt

[57] ABSTRACT

There are described reversal photographic elements containing magenta dye-forming couplers that yield dye images that particularly lend themselves to retouching. The photographic element comprises a pyrazoloazole magenta dye forming coupler having a cleavable ballast group joined to the remainder of the molecule by one or two electrophilic cleavage groups which can be removed with a specialized processing composition after reversal processing.

7 Claims, No Drawings

RETOUCHABLE REVERSAL SILVER HALIDE PHOTOGRAPHIC ELEMENT WITH A PYRAZOLOAZOLE MAGENTA DYE-FORMING COUPLER

This application is a continuation in part of our prior U.S. patent application Ser. No. 08/154,839, filed Nov. 19, 1993, now abandoned, which is a division of U.S. patent application Ser. No. 07/872,473 filed Apr. 23, 1992, now U.S. Pat. No. 5,296,337 issued Mar. 2, 1994.

FIELD OF THE INVENTION

This invention relates to novel reversal silver halide color photographic elements containing novel pyrazoloazole dye forming couplers that provide magenta dye images that can readily be retouched using novel retouching compositions.

BACKGROUND OF THE INVENTION

Images are formed in silver halide color photographic materials by the dye that results from reaction between oxidized silver halide developing agent and a dye forming compound known as a coupler. It is known to retouch such dye images by selective destruction and/or removal of dye. Retouching techniques are described in photographic publications and literature, such as Professional Photographer, November 1989, Vol. 116, No. 2130, pages 44–48, Professional Photographer, December 1989, Vol. 115, No. 2131, pages 30–34, and in Harder et al. U. S. Pat. No. 4,990,430 issued Feb. 5, 1991.

A problem with the known methods of retouching is that they depend on the selective destruction or solubilization of dyes formed from couplers chosen for reasons other than their retouchability. Thus, it is difficult to differentially remove dye density of one color without also affecting dye of another color. This is particularly true of relatively stable dyes, such as those derived from pyrazoloazole couplers. In photographic elements containing magenta dye images formed from pyrazoloazole dye forming couplers, it is difficult to remove the magenta dye without also affecting the images formed from the cyan and yellow dyes.

The ability to retouch images is particularly desirable in materials used for commercial photography, where there frequently is the desire to get exactly the right color in a particular area of the image. Since reversal materials frequently are the photographic film of choice for commercial photography, it would be highly desirable to provide such materials with the ability to be retouched easily.

Silver halide color reversal films are typically associated with an indication for processing by a color reversal process. Typically this means that the film, its container, or its packaging, will have an indication on it that the film should be processed by a color reversal process. The indication may, for example, be simply a printed statement that the film is a "reversal film" or that it should be processed by a color reversal process, or simply a reference to a known color reversal process such as "Process E-6". A "color reversal" process in this context is one employing treatment with a non-chromogenic developer, followed by fogging unexposed silver halide, after which the element is treated with a color developer.

In a typical construction, color reversal elements do not contain any masking couplers, such as are commonly used in color negative elements. Furthermore, reversal films have a contrast (gamma) generally between 1.5 and 2.0, which is much higher than for typical negative materials. Moreover, reversal developer compositions typically are free of nucleophiles, such as hydroxylamines, which are found in developer compositions intended for use with color negative elements.

SUMMARY OF THE INVENTION

We have found that good retouchability in color reversal elements can be obtained by use in the light sensitive element in which the image is formed of a pyrazoloazole magenta dye forming coupler that contains a cleavable ballast group on the coupler moiety, which ballast group remains on the dye formed on coupling of the coupler with oxidized silver halide color developing agent. The ballast group is clearable by a specialized retouching composition to cause the image dye to be solubilized and removed from the photographic element.

Thus, in one aspect, this invention relates to a light sensitive reversal photographic element comprising a support bearing a silver halide emulsion associated with a pyrazoloazole magenta dye-forming coupler having the structure:

$$\text{Bal-P}_1 \qquad \text{I.}$$

where:

$P_1$ is a pyrazoloazole dye forming coupler moiety, and

Bal is an organic ballast group a) which is attached to the coupler at a position other than the coupling position, b) which immobilizes the coupler and the dye formed from the coupler on color development, c) which is not cleavable from the coupler during reversal color photographic processing, but d) which is cleavable from the dye by reaction with a dinucleophile to thereby render the dye mobile.

DETAILED DESCRIPTION OF THE INVENTION

Couplers useful in the reversal elements of this invention contain a cleavable ballast group comprising one or two electrophilic cleavage groups that are capable of reacting with a dinucleophile. Preferred couplers have two such groups, in which case the less electrophilic is closer to the cleavage site and is separated from the more electrophilic group by a bond, an atom, or a group of atoms that permits a nucleophilic displacement reaction to occur with cleavage of the ballast group.

Couplers useful in the reversal elements of this invention have ballast groups (Bal in structure I above) that can be represented by the structures:

$$\text{II.}\quad \text{BAL}'-(E_1)_u-(Y_1)_v-E_2-(T_1)_w-(T_2)_x-(L)_y-$$

$$\text{III.}\quad \text{BAL}'-(T_2)_x-(T_1)_w-(E_1)_u-(Y_1)_v-E_2-(L)_y-$$

$$\text{IV.}\quad \text{BAL}'-(E_1)_u-(Y_1)_v-E_2-\underset{\underset{(\text{BAL}')_x-(T_2)_x}{|}}{(T_1)_w}-(L)_y-$$

wherein:

BAL' is an organic group that provides sufficient bulk with the remainder of the molecule to maintain the coupler in the layer in which it is coated;

$E_1$ and $E_2$ are independently electrophilic groups;

$T_1$ and $T_2$ are individually releasable timing groups;

$Y_1$ is an atom or group, preferably a carbon or nitrogen atom, that provides a distance between $E_1$ and $E_2$ that permits a nucleophilic displacement reaction to occur;

L is linking group comprising an alkyl, aryl, alkaryl or heterocyclyl group that links the coupler moiety to the remainder of the molecule and can be selected to simplify manufacture, or to influence such properties as rate of cleavage, rate of coupling, dye hue and dye stability;

one of BAL', $T_1$, $T_2$, L or $P_1$ contains a sulfur, nitrogen or oxygen atom through which it is bonded to $E_1$ or $E_2$;

u, v, w, x and y are each 0 or 1;

if u is 1, v is 1 and if u is 0, v is 0; and when u is 0, the group cleaved from $E_2$ has a $pK_a$ of 12 or less, and when u is 1, the group cleaved from $E_1$ or $E_2$ has a $pK_a$ of 16 or less.

In these ballast groups, preferably $E_1$ is more electrophilic than $E_2$, and the bond between $E_1$ or $E_2$ and the remainder of the molecule is the point at which cleavage occurs when the the dye formed from the coupler is treated with the dinucleophile containing retouching composition. This bond should not be so fragile that it will cleave during normal photographic processing, but it should be sufficiently labile that cleavage occurs in a reasonable time, e.g., 0.5 to 15 minutes, preferably 1 to 5 minutes, during the retouching process. These conditions exist when the electrophilic group, $E_1$ or $E_2$, at which cleavage occurs is joined to a sulfur, nitrogen or oxygen atom, and the group which is cleaved from the electrophilic group has a pKa of 16 or less when Bal has both $E_1$ and $E_2$ groups, and has a pKa of 12 or less when Bal has only an $E_2$ group. For the purposes of this invention, pKa is measured as described in Strobel, *Chemical Instrumentation: A Systematic Approach to Instrumental Analysis;* Addison-Wesley, Reading, Mass., 1960; pp 479–483; or can be calculated as described in Perrin, Dempsey and Serjeant, *PKa Prediction for Organic Acids and Bases;* Chapman and Hall, New York, 1981.

As indicated above, structures II, III, and IV represent the organic ballast group, Bal, in structure I, above. Further details of these ballast groups are shown below and in Buchanan et al. U.S. Pat. No. 5,019,492 issued May 28, 1991. The Buchanan et al. patent shows some of these groups as blocking groups which are released from photographically useful groups (PUGs) during photographic processing. The disclosure of Buchanan et al. is incorporated herein by reference.

The coupler moiety represented by $P_1$ in structure I is, as indicated, a pyrazoloazole.

Preferred pyrazoloazoles include 1H-pyrazolo[2,3-c]-s-triazoles, 1H-pyrazolo[2,3-b]-1,2,4-triazoles, 1H-pyrazolo[5,1-c]-1,2,4-triazoles, 1H-imidazo[1,2-b]pyrazoles, 1H-pyrazolo[1,5-d]tetrazoles, and 1H-pyrazolo[1,5-b]-1,2,4-triazoles.

Such couplers are described, inter alia, in the following patents, the disclosures of which are incorporated by reference: U. S. Pat. Nos. 3,725,067 and 4,882,266, British Patents 1,252,418 and 1,334,515, and European Published Patent Application 119,741.

Particularly preferred couplers have ballast groups that contain electrophiles that are carbonyls or dicarbonyls. These couplers can be represented by the formulae:

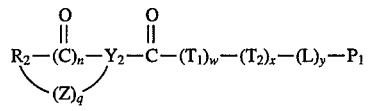

V

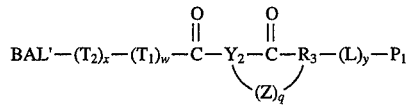

VI wherein:

$P_1$ is a pyrazoloazole coupler moiety;

$R_2$ is hydrogen, alkyl, aryl, or the atoms that together with Z and $Y_2$ complete a ring, particularly an alicyclic or heterocyclic ring;

$R_3$ is alkylene, arylene, or the atoms that together with Z and $Y_2$ complete a ring, particularly an alicyclic or heterocyclic ring;

Z represents the atoms necessary to complete a ring with $R_2$ or $R_3$ and $Y_2$;

$Y_2$ is a carbon or nitrogen atom in a group that, when n is 1, provides a distance between the carbonyl groups that enables a nucleophilic displacement reaction to occur;

y, n, q, x and w are 0 or 1; when n is 0, q is 0;

$T_1$, $T_2$, L, BAL', and $P_1$ are as described above.

Highly preferred couplers that contain carbonyl ballasts are represented by the formulae:

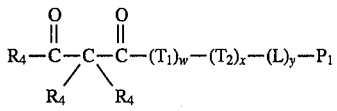

VII

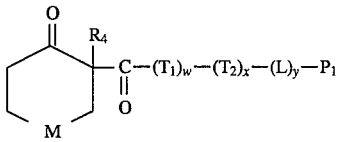

VIII

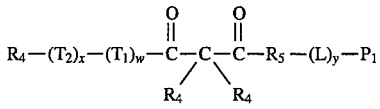

IX and

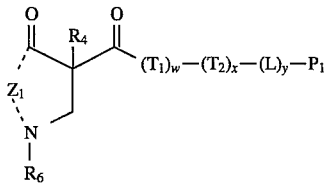

X wherein:

each $R_4$ individually is alkyl or aryl;

$R_5$ is alkylene or arylene;

$R_6$ is hydrogen, $COR_7$, $CO_2R_7$, $SO_2R_7$, $P(O)(OR_7)_2$, alkyl, aryl or another group that does not affect photographic performance;

$R_7$ is hydrogen, alkyl, aryl, or $NR_8R_9$;

$R_8$ and $R_9$ individually are hydrogen, alkyl, or aryl;

$Z_1$ represents the atoms to complete a 5-, 6- or 7-membered heterocyclic ring or fused ring system;

$P_1$, L, $T_1$ and $T_2$ are as previously defined;

M is $—CH_2—$, —O—, or $—S(O)_q—$ where q is 0, 1 or 2;

w, x, and y are independently 0 or 1.

As shown above, the coupler can optionally contain one or more timing groups, $T_1$ and $T_2$, between the coupler moiety and the cleavable group or between the ballast and the cleavable group. The reaction of the image dye with a dinucleophile reagent can sequentially release the clearable group from the timing group and then the timing group release the image dye or the ballast as described. The term "timing group" herein also includes a linking group that involves little or no observable delay in the releasable action. Any timing group that is known in the photographic art is useful as the timing group. Examples of useful timing groups are described in, for example, U.S. Pat. Nos. 4,248,962 and 4,409,323 and European Patent Application 255,085.

The particular timing groups employed, including the linkage by which they are attached to COUP or BAL and the cleavable group and the nature of the substitutents on the timing group can be varied to help control such parameters as rate and time of bond cleavage of the cleavable group and the COUP or BAL as well, ease of synthesis of the complete coupler, and the location of the hydrophobic substituents necessary to insure the coupler is properly ballasted.

If the coupler moiety is joined to the cleavable group only through the timing group, then the cleavage of the bond between the timing group and the cleavable group releases the timing group and the coupler derived dye as a unit. The particular timing group in this case can control the rate at which the dye will be retained in the photographic element. In most cases, a faster rate of release from the timing group is preferred over a slower release rate. The timing group should not contain a structure that inhibits the reaction of the cleavable group with a dinucleophile reagent.

In the formula as described timing groups $T_1$ and $T_2$ are independently selected to provide, e.g., the desired rate and time of release of the coupler derived dye upon retouching. The timing groups $T_1$ and $T_2$ can be the same or different. Examples of preferred timing groups for $T_1$ and $T_2$ are as follows:

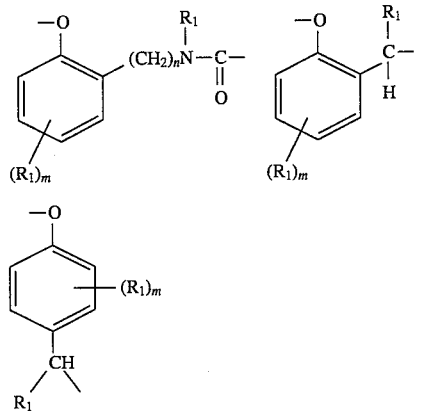

wherein:

m is 0 to 4, n is 0 or 1, and each $R_1$ is individually hydrogen or a substituent, such as alkyl, aryl, nitro, chloro, acetamido, sulfonamido, sulfamoyl, carbamoyl, or carboalkoxy.

Other examples of useful timing groups are described in, for example, U.S. Pat. Nos. 4,248,962 and 4,772,537.

In the cleavable group as described the two electrophilic groups, $E_1$ and $E_2$, can be any electrophilic group that enables nucleophilic displacement reaction to occur upon reaction of the blocking group with dinucleophile reagent. While carbonyl groups are highly preferred as the electrophilic groups, other examples of useful electrophilic groups are as follows:

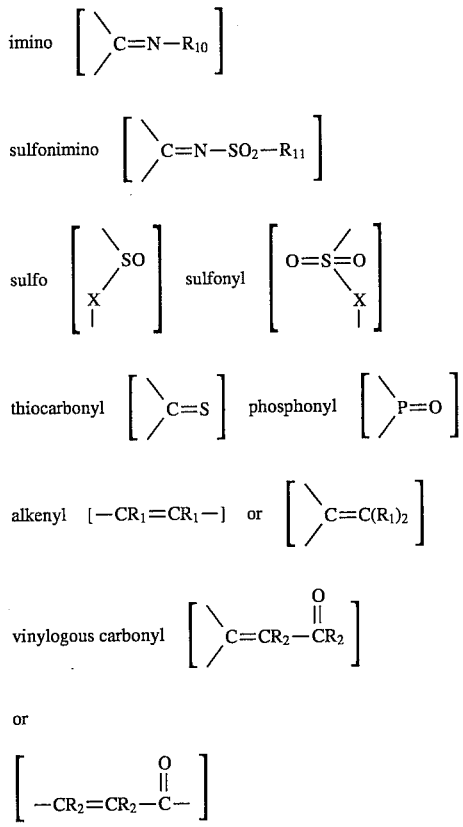

wherein $R_{10}$ is alkyl, aryl, $COR_7$, $NR_8R_9$, or $P(O)(OR_7)_2$;

$R_{11}$ is alkyl, aryl, $OR_7$ or $NR_8R_9$;

$R_1$, $R_2$, $R_7$, $R_8$ and $R_9$ are as defined above and X is a sulfur, nitrogen or oxygen atom, such that the attached sulfur atom is an electrophilic center.

Highly preferred cleavable groups are:

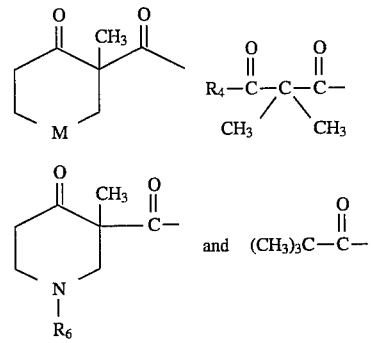

wherein M, $R_4$ and $R_6$ are as defined above.

Dye images are formed with these couplers by reaction between the coupler and oxidized silver halide developing agents. Suitable developing agent comprise p-aminophenols and p-phenylene diamines such as are descibed in the Research Disclosures publication referred to infra.

The dye image so formed can be modified in hue, density, or both by application of a retouching composition. The retouching composition comprises an aqueous solution of a dinucleophile and a water-soluble organic co-solvent. The dinucleophile serves to effect cleavage of the ballast group while the organic solvent serves to solubilize the reaction products of cleavage and facilitate dye removal from the element.

Suitable dinucleophiles include compounds represented by the formula:

$$HNu_1—X_1—Nu_2H$$

wherein:

$Nu_1$ and $Nu_2$ are individually nucleophilic N, O, S, P, Se, substituted nitrogen atoms or substituted carbon atoms;

$X_1$ is a chain of j atoms wherein j is 0, 1 or 2. Illustrative examples of suitable dinucleophiles are:

| j = 0 | j = 1 | j = 2 |
|---|---|---|
| $H_2O_2$ | $NH_2CONH_2$ | $NH_2CH_2CH_2NH_2$ |
| $NH_2NH_2$ | 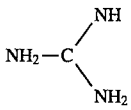 | $NH_2CH_2CO_2H$ |
| $CH_3NHNHCH_3$ | 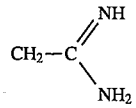 | $NH_2C(CH_3)_2CH_2OH$ |
| $NH_2OH$ | | $NH_2CH_2CH_2SH$ |
| $CH_3NHOH$ | | 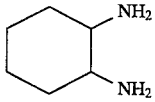 |
| $CH_3C(=O)—NHOH$ | | |
| $CH_3SO_2NHNH_2$<br>EtNHOH<br>$(CH_3)_2NOH$<br>$PhNHNH_2$<br>$NH_2NHCH_2CH_2OH$ | | |

Preferred dinucleophile reagents are hydroxylamine, hydrogen peroxide, and monosubstituted hydroxylamine. The dinucleophile reagent herein also includes a salt form of the reagent, such as the acid salts, for example, sulfate or bisulfite salts.

Suitable water soluble organic co-solvents are soluble in water in an amount of 5% by weight or greater and include acetonitrile, tetrahydrofuran, 1,3-dioxane, 1,4-dioxane, 1,3-dioxolane, dimethoxyethane, diglyme, triglyme, ethanol, methanol, n-propanol, i-propanol ethyleneglycol, glycerol, diethyleneglycol, 1-methyl-2-pyrroldinone, sulfolane, dimethylsulfoxide, triethylamine, morpholine, N-methylmorpholine, N,N'-dimethyl-propyleneurea. Preferred are methanol, ethanol and acetonitrile.

The retouching composition preferably is basic and most preferrably is at a pH in the range of 9.0 to 12.5; the pH value being that which would be read if an equal volume of water were substituted for the organic solvent.

The organic solvent is typically employed in admixture with water in proportions ranging from 1 to 9, to 9 to 1 parts by volume. The dinucleophile is employed in a concentration ranging from 0.01 molar up to the solubility limits in the particular solvent system with which it is employed.

In a preferred embodiment, the dinucleophile concentration is between about 0.5 and 3.0 molar and the organic solvent comprises between 45 and 70 parts by volume of the solvent system.

The retouching composition can be employed by local application to the desired region of the photographic element or by dipping the element in a bath of the composition for a time sufficient to reduce the density of the dye to the desired level. Details of useful procedures are described in the articles from Professional Photographer referred to above. In some cases it may be advantageous to treat the element first with the retouching solution and then remove the cleaved dye by washing with a separate solution of an acidic or basic solution of one or more of the cosolvents.

Novel couplers of this invention can be prepared by conventional synthetic techniques such as those describe in the patents referred to supra, and illustrated in the synthetic example infra.

Examples of couplers useful in this invention are show in Table 1, which follows.

TABLE 1

Coup 1

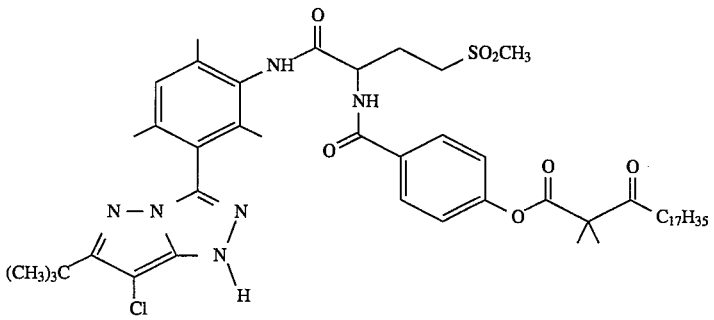

TABLE 1-continued
Coup 2
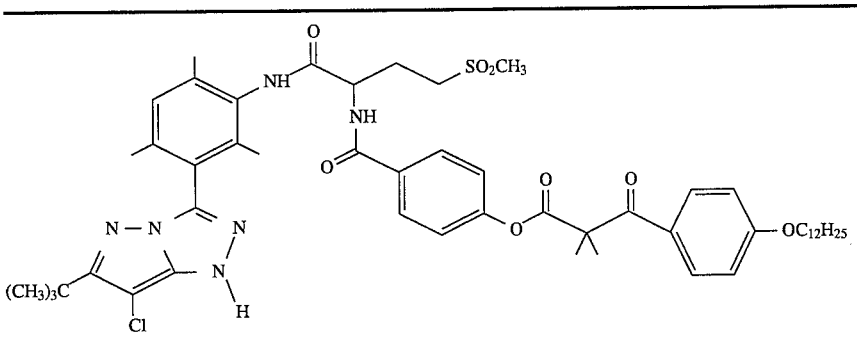
Coup 3
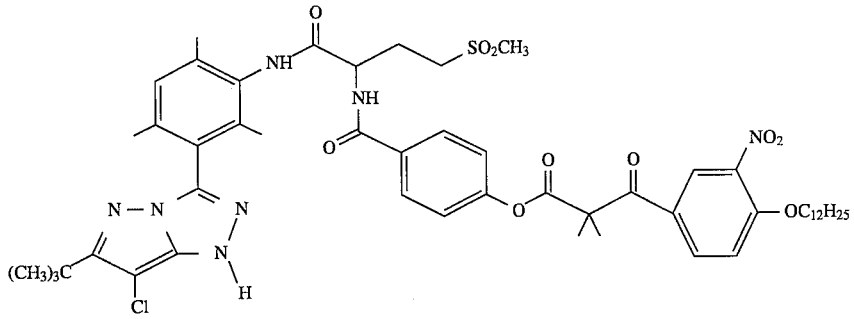
Coup 4
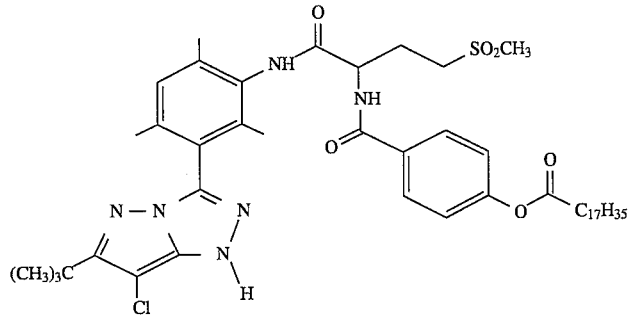
Coup 5
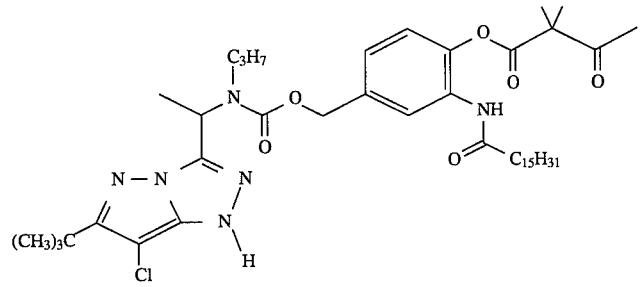
Coup 6
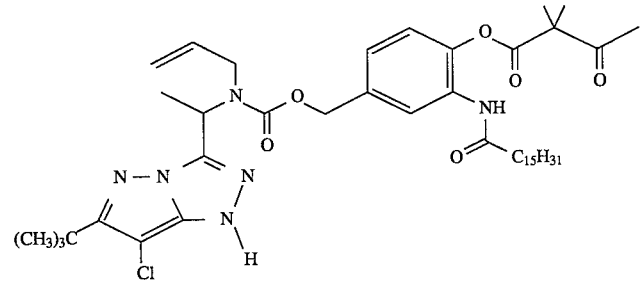
Other pyrazoloazole couplers contain the following ballast groups attached to a non-coupling position of one of the coupler moieties in the specific couplers shown above, or another known coupler moiety. In the structures shown below, the coupler moiety is identified as $P_1$.

Table 1, cont'd
Coup 7
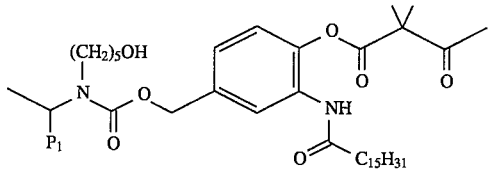
Coup 8
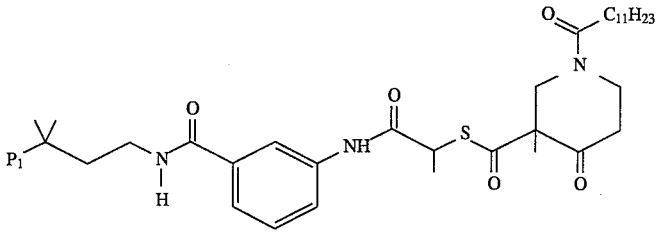
Coup 9
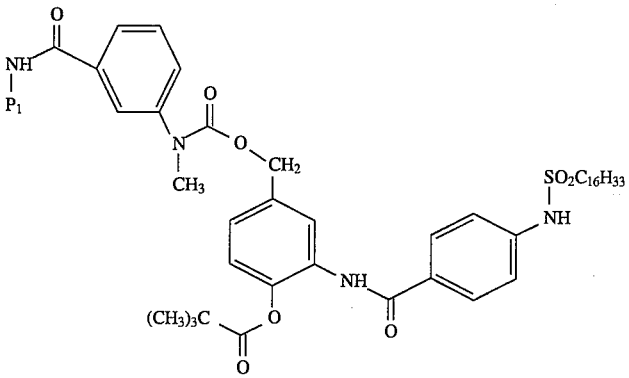
Coup 10
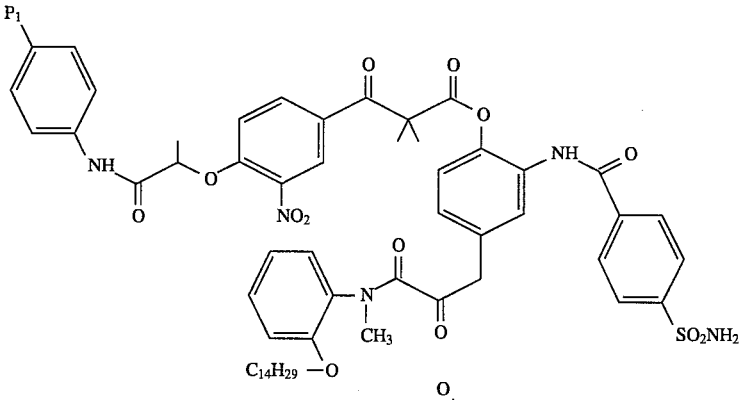
Coup 11
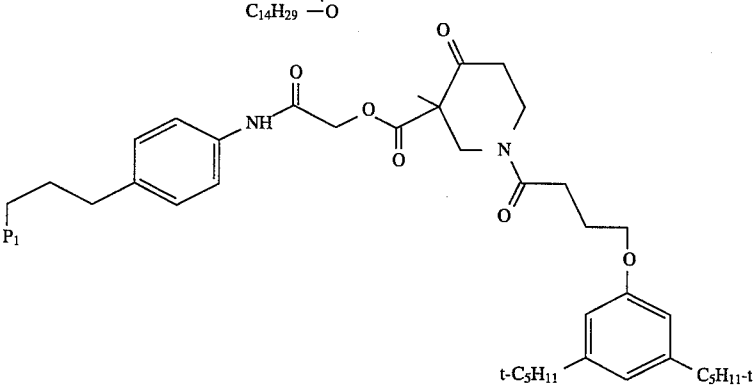

-continued
Coup 12
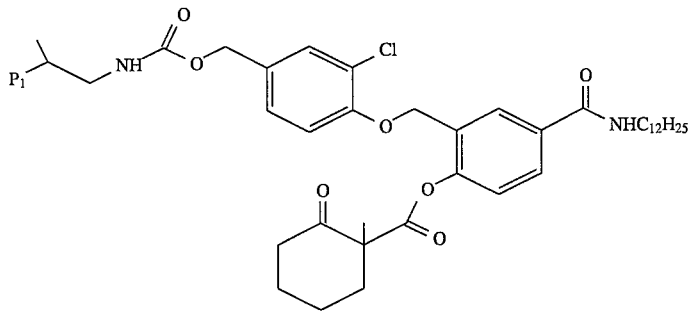
Coup 13
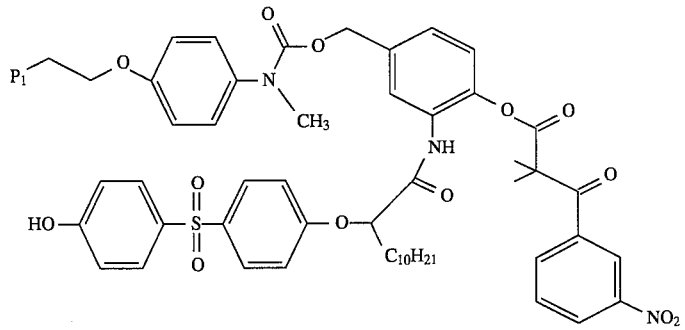
Coup 14
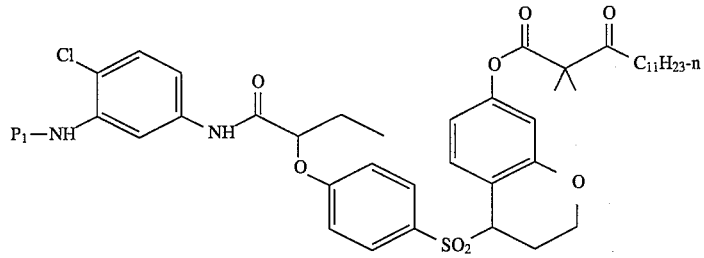
Coup 15
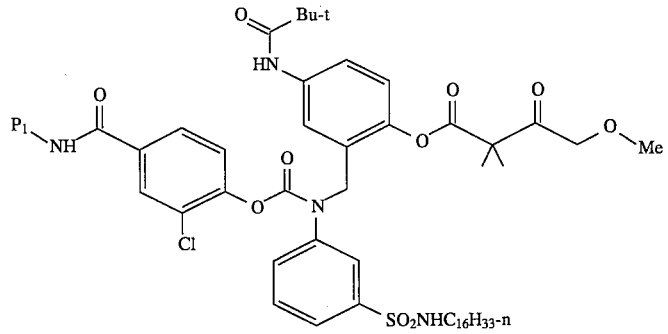
Coup 16
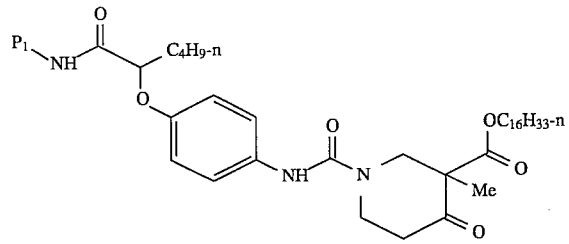

-continued
Coup 17
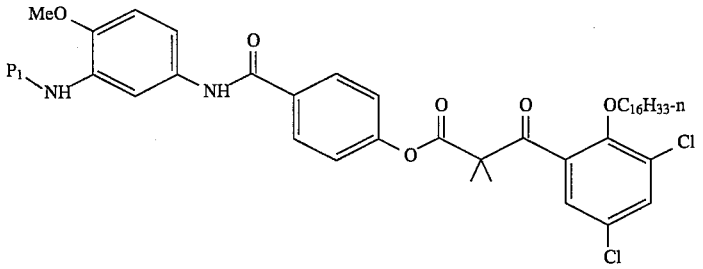
Coup 18
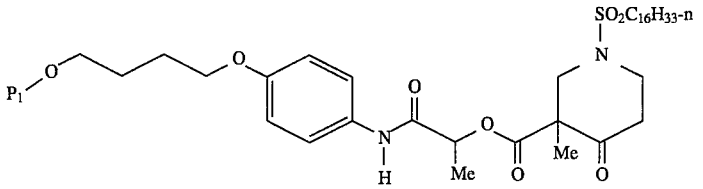
Coup 19
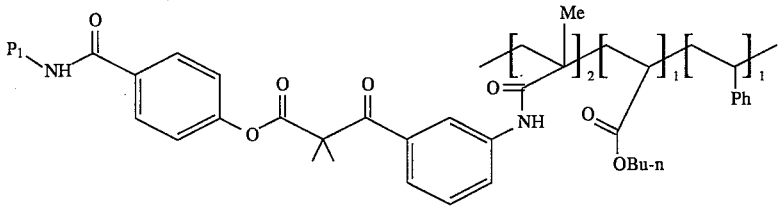
Coup 20
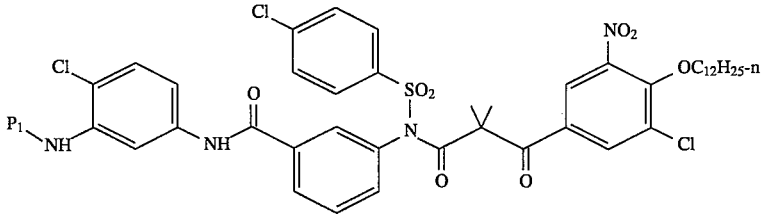
Coup 21
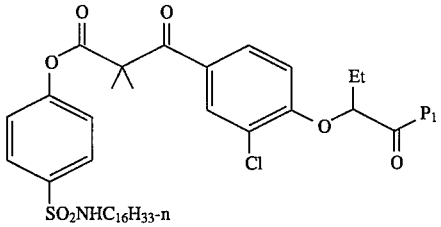
Coup 22
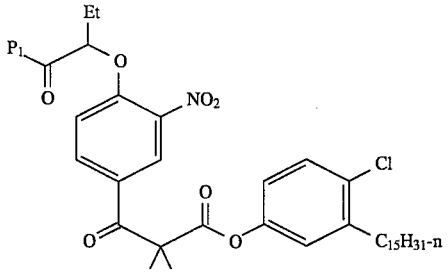
Coup 23
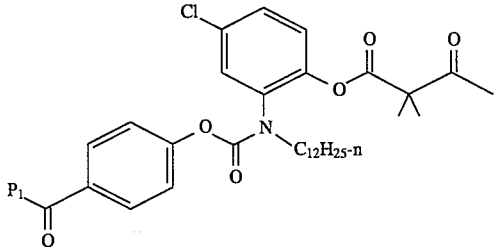

-continued
Coup 24
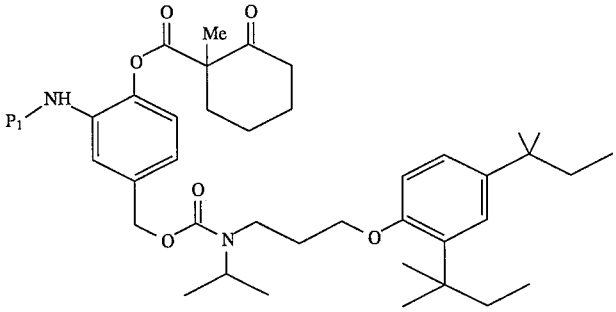
Coup 25
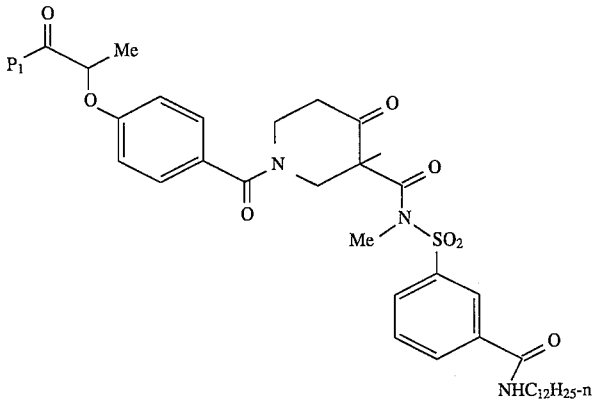
Coup 26
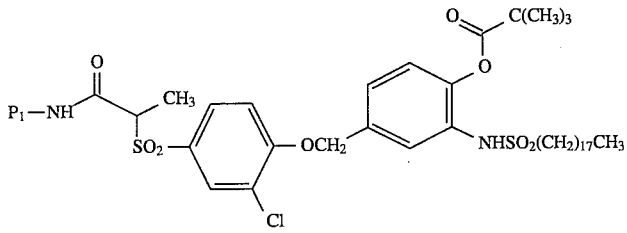
Coup 27
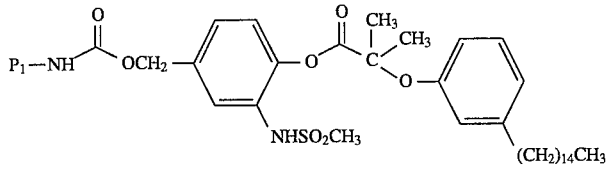
Coup 28
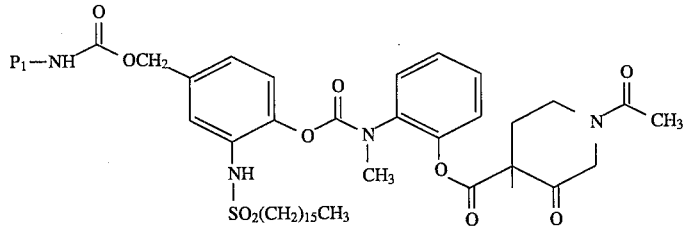
Coup 29
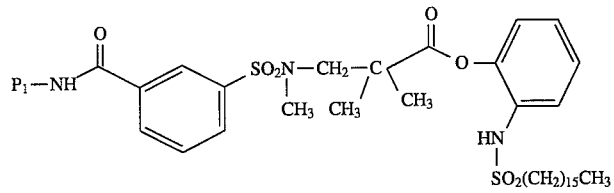

-continued
Coup 30
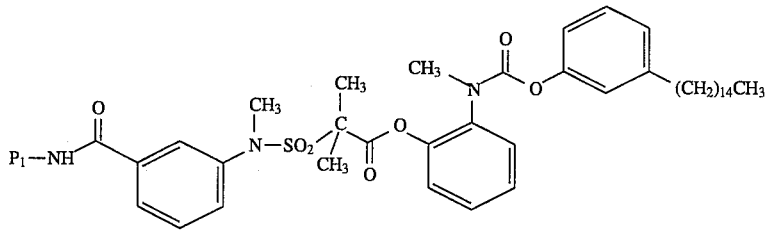
Coup 31
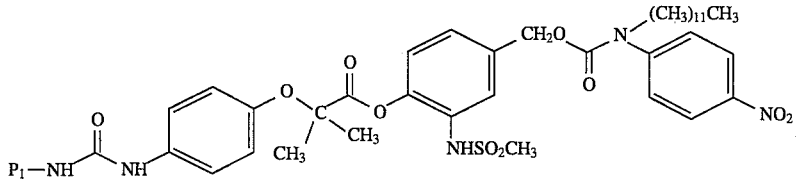
Coup 32
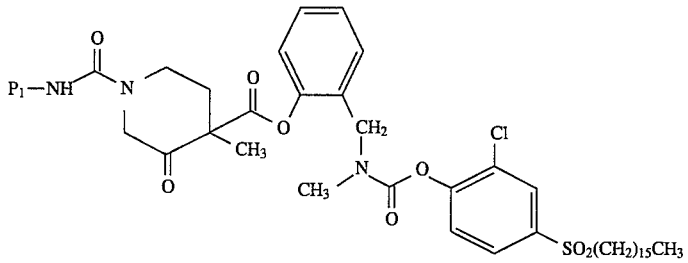
Coup 33
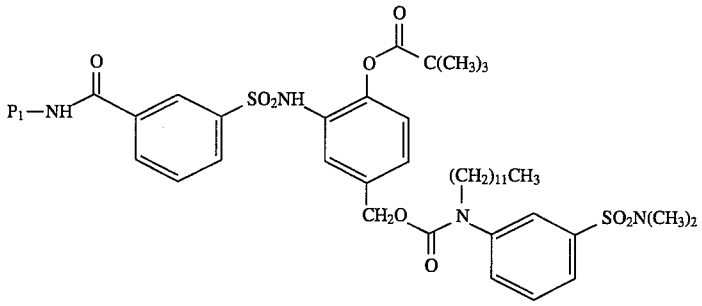
Coup 34
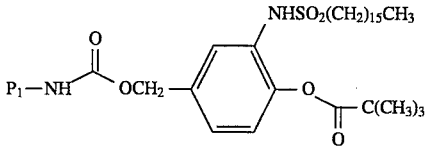
Coup 35
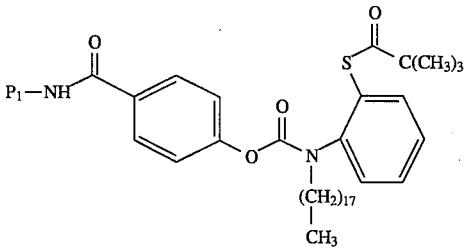

-continued

Coup 36

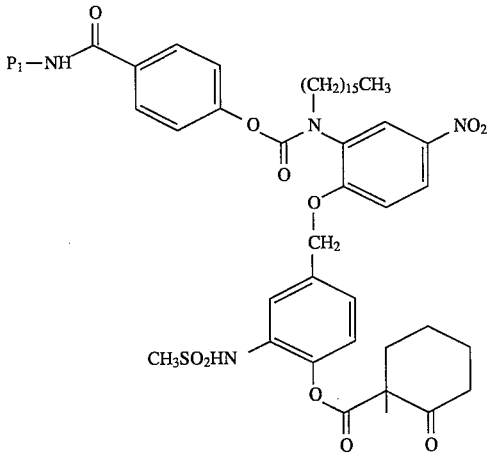

Coup 37

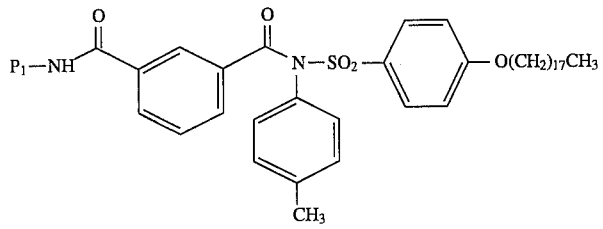

Coup 38

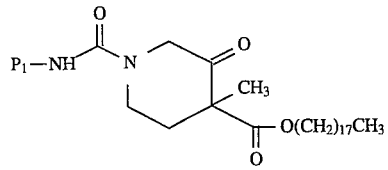

Coup 39

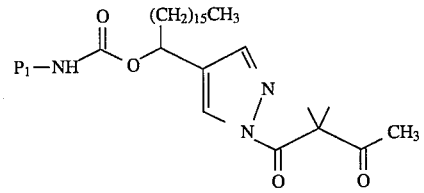

Coup 40

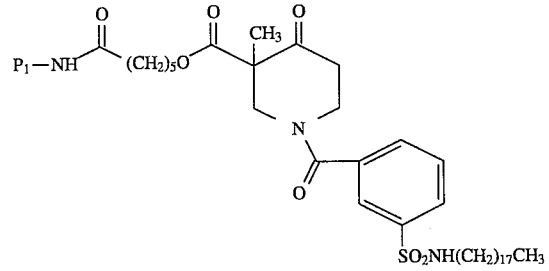

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy. If desired, the substituents may themselves be further substituted one or more times with the described substituent groups.

The photographic elements can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

The coupler compounds can be used and incorporated in photographic elements in the way that such compounds have been used in the past. Incorporation by use of a coupler solvent, as shown in the working examples, is a preferred technique.

The photographic elements of this invention can be exposed to actinic radiation, typically in the visible region of the spectrum, to form a latent image, as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Couplers of the invention can be prepared by reactions and methods known in the organic synthesis art. A typical synthesis is illustrated by the following example.

Preparation of Compound A-1

Isobutyric acid (15.5 g, 176 mmol) was added to a −20° C. solution of lithium diisopropylamide (353 mmol) in THF (800 mL) over ten minutes, and the mixture was allowed to warm to ambient temperature. After 3 h, all the volatiles were removed in vacuo with gentle heating (<50° C.) to provide a yellow powder. The powder was redissolved in THF, and the solution was cooled to −78° C. Stearoyl chloride (53.4 g, 176 mmol) in THF (34 mL) was added rapidly, and the mixture was permitted to warm to ambient temperature. After stirring overnight, the mixture was cooled to −20° C., treated with chloromethyl ethyl ether (24.8 g, 262 mmol), and permitted to warm to ambient temperature.

Synthesis of Coupler #1

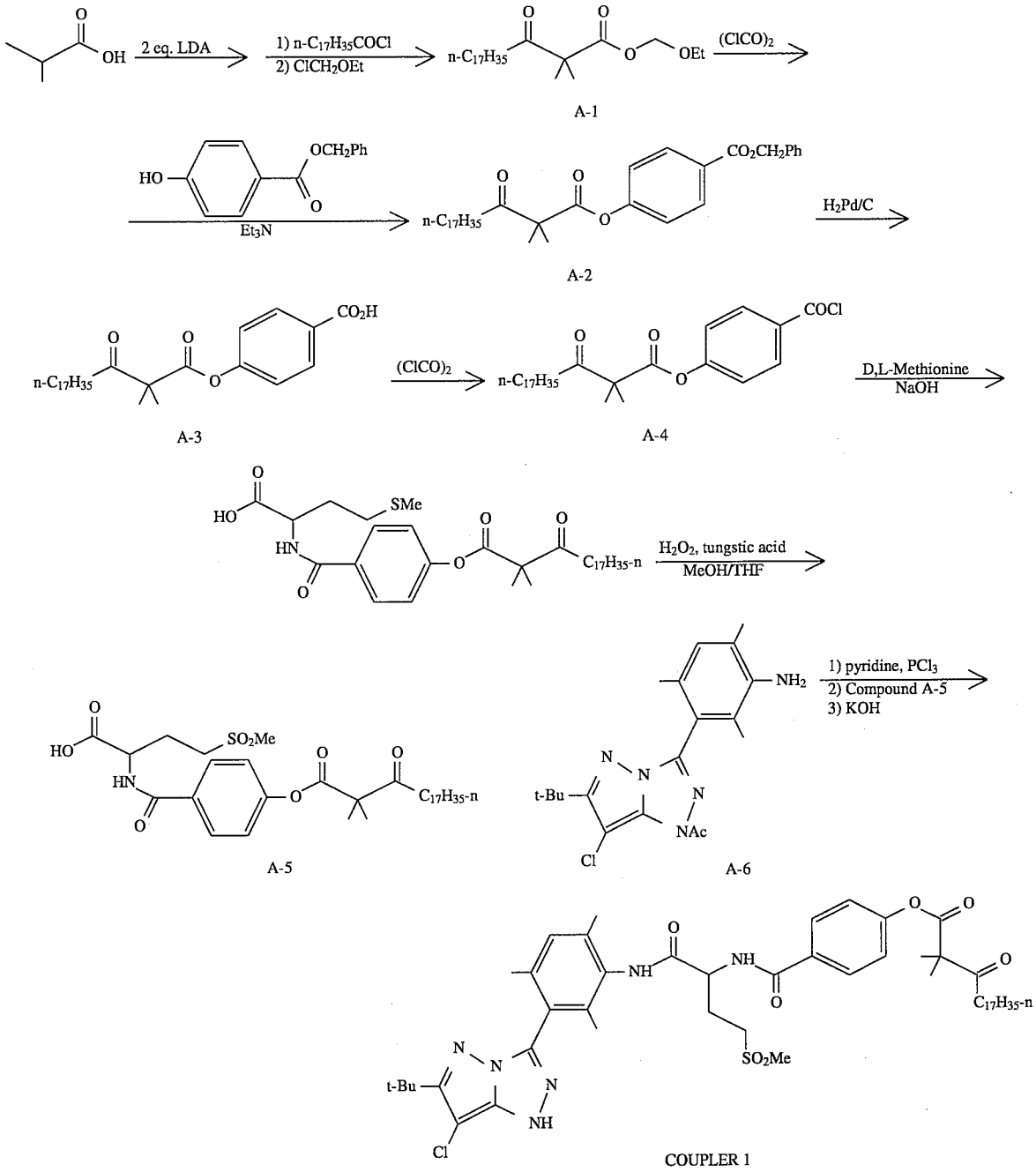

After 3.5 h the mixture was diluted with ether (1 L), washed with saturated $NaHCO_3$ (2×250 mL), 5% $NaHCO_3$ (150 mL), brine (150 mL), dried ($MgSO_4$), and concentrated in vacuo to afford an oil. Chromatography on silica gel, using 3:2 heptane/dichloromethane eluent provided compound A-1 (27.5 g).

Preparation of Compound A-2

A dichloromethane solution (35 mL) of compound A-1 (22.1 g, 54 mmol), chilled in an ice bath, was treated with oxalyl chloride (20.4 g, 161 mmol), 90% DMF (aq.) (0.10 mL), and then removed from the ice bath and permitted to warm to ambient temperature. After 5.5 h all volatiles were removed in vacuo with gentle heating (<40° C.).

The acid chloride was redissolved in dichloromethane (70 mL), cooled in ice, treated with triethylamine (10.9 g, 108 mmol) and benzyl p-hydroxybenzoate (12.3 g, 54.0 mmol), and permitted to warm to ambient temperature. After stirring overnight the reaction mixture was diluted with ethyl acetate (1 L), washed with 1N HCl (1×100, 1×50 mL), water (50 mL), brine (50 mL), dried ($MgSO_4$), and concentrated in vacuo. Chromatography on silica gel (major band), using 4–20% ethyl acetate/heptane eluent provided compound A-2 (23.4 g) as a white solid.

Preparation of Compound A-3

Hydrogenolysis of the benzyl ester of A-2 (22.6 g, 40.0 mmol) was effected in ethyl acetate (215 mL), using 10% Pd/C as catalyst (2.27 g), in a Parr hydrogenator at ca. 50 PSI of hydrogen, overnight. The catalyst was removed by filtration and the filtrate was concentratead in vacuo to provide compound A-3 (18.5 g) as a white solid.

Preparation of Coupler #1

A solution of acid A-3 (4.79 g, 10.1 mmol) in THF (20 mL) was treated with oxalyl chloride (2.56 g, 20.2 mmol) and DMF (0.10 mL). After stirring for 1 h, the volatiles were removed in vacuo to provide compound A-4 as a brown solid. This was used in the subsequent reaction.

The ballast acid A-5 was prepared in two steps from acid chloride A-4 using the method described in U.S. Pat. No. 5,021,325. Reaction of A-5 with 1-acetyl-6-t-butyl-7-chloro-(3-amino-2,4,6-trimethyl-1-Phenyl)-1H-pyrazolo-[3,2-c]-1,2,4-triazole (compound A-6) and subsequent deacetylation also uses the method described in U.S. Pat. No. 5,021,325. Chromatography on silica gel (major band), using 50% ethyl acetate/dichloromethane eluent provided coupler 1 as a tan glass. Analysis for $C_{51}H_{75}ClN_6O_7S$ (calc., found): C (64.36, 64.08); H (7.94, 7.80); N(8.83, 8.77).

The following examples further illustrate this invention.

EXAMPLE 1

(Invention)

To demonstrate the practice of the invention coupler #3 shown in Table 1, above, was incorporated into a photographic element as follows:

A green sensitive silver bromoiodide gelatine emulsion was mixed with a coupler dispersion comprising coupler #3 dispersed in half its weight of a mixture of tritolyl phosphates. The resulting mixture was coated onto a cellulose triacetate support according to the following format:

| | | |
|---|---|---|
| OVERCOAT LAYER: | gelatine | 7.5 g/m² |
| | bis(vinylsulfonylmethyl) ether hardener (1.9% of total gelatine weight) | |
| EMULSION | AgBrI emulsion | .73 g/m² (as silver) |

-continued

| | | |
|---|---|---|
| LAYER: | Coupler #3 | 1.94 mmoles/m² |
| | Gelatine | 3.2 g/m² |
| FILM SUPPORT: | | |

The resulting photographic element was imagewise exposed to light through a graduated density test object in a commercial sensitometer (3000K light source, 0–3 step wedge, with a Wratten 99 plus 0.6 ND filter) to provide a developable latent image. The film was then developed using the E6 process described in *The British Journal of Photography Annual,* 1977, pages 194–7, with the final stabilizing bath omitted, to yield an image in magenta dye having a Status A green maximum density of 2.44.

A retouching solution according to the invention was prepared by mixing 7.7 g of 30 percent by weight hydrogen peroxide solution with 20 cc of a carbonate buffer having an ionic strength of 0.375 and a pH of 10. To this mixture was added 50 cc of 3A alcohol and the resulting mixture was diluted with distilled water to a total volume of 100 cc. A 1 cm square of the maximum density area of the processed element was suspended in the retouching solution subjected to gentle stirring. After 5 minutes the film was removed, rinsed with tap water and dried. The Status A green density of the film so treated was read and found to have been reduced to 0.99. This illustrates that the retouching solution was effective to reduce the dye density of the magenta dye formed from coupler #3.

Example 2

(Comparison)

A photographic element was prepared and treated as in Example 1 except that comparison coupler X-1 (structure shown below) not having a clearable ballast was employed. The sample had a Status A green density of 4.32 after treating with the retouching solution for 5 minutes compared to a density of 4.43 before treatment. This illustrates that the dye formed from this coupler is substantially unaffected by the retouching solution.

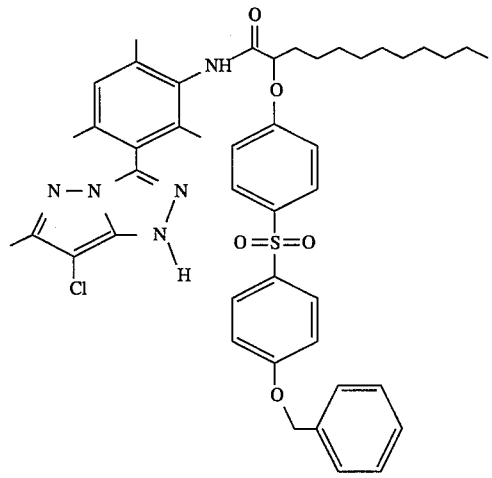

Comparison Coupler X-1

EXAMPLE 3

(Comparison)

The photographic element prepared in Example 1 was treated with a retouching solution prepared as in Example 1 except that hydrogen peroxide, the dinucleophile, was omitted. After treating with this retouching solution the photographic film had a Status A green density of 2.29 after 5 minutes. This illustrates that without a dinucleophile the retouching solution is of limited effectiveness.

EXAMPLE 4

(Invention)

A photographic element was prepared and treated as in Example 1, except that coupler #4 from Table 1 was employed in place of coupler #3. The sample had a Status A green maximum density of 2.65 prior to treatment with the retouching solution, and a density of 1.25 after a 5-minute treatment.

EXAMPLE 5

(Comparison)

A photographic element was prepared and treated as in Example 4 except that the hydrogen peroxide was omitted from the retouching solution. After a 5-minute treatment the Status A green maximum density was 2.01. This illustrates the importance of the dinucleophile hydrogen peroxide in retouching dyes derived from couplers having simple ester cleaving groups.

EXAMPLE 6

(Invention)

A photographic element was prepared, exposed and developed as in Example 1 to yield a film sample having a Status A green maximum density of 2.48. A solution was prepared by dissolving 19.2 g of hydroxylamine hydrochloride in approximately 50 cc of distilled water and the solution pH adjusted to 8.05 by adding 50% sodium hydroxide dropwise, and the resulting solution volume adjusted to 100 cc with distilled water. A retouching solution was prepared by mixing 48 cc of the above solution with 50 cc of a carbonate buffer having an ionic strength of 0.515 and a pH of 10, 100 cc of 3A alcohol, and adjusting the total volume to 200 cc. A 1 cm square sample from the maximum density area of the film was suspended in this solution while gently stirring. After 5 minutes the sample was removed, rinsed with tap water, and allowed to dry. The Status A green density of the treated sample was 0.79. This illustrates the effectiveness of alternate dinucleophiles.

EXAMPLE 7

Photographic element were prepared, exposed, and developed as in example 1 except that the couplers from Table 1, above, as shown in Table 2, below, were in each case substituted for coupler #3. Samples from the maximum density area of each film were treated with retouching solution as in Example 1 and, after rinsing and drying the Status A green density were read. The results showing the extent of dye bleaching are tabulated in Table 1.

TABLE 2

| COUPLER # | Density Before Retouching | Density After Retouching |
|---|---|---|
| #1 | 2.44 | 1.21 |
| #2 | 3.60 | 3.50 |
| #6 | 3.48 | 1.92 |

When the time that the element containing Coupler #2 and was extended from 5 minutes to 13 minutes, the Status A density obtained was 2.51.

EXAMPLE 8

A multilayer film was prepared as follows:

On a cellulose triacetate support provided with a subbing layer was coated, in order, layers having the compositions set forth below, so as to prepare a multilayer color photographic light-sensitive material.

In these layers, the amounts of the components are shown as g/m$^2$ except for sensitizing dyes, which are shown as the moles per mole of silver halide present in the same layer.

| | |
|---|---|
| First layer: Antihalation Layer | |
| Black Colloidal Silver | 0.43 (as silver) |
| Gelatin | 2.44 |
| Second layer: Intermediate Layer | |
| Gelatin | 1.22 |
| Third layer: Slow Red Sensitive Layer | |
| Silver iodobromide Emulsion | 0.36 (as silver) |
| Red sensitizing dyes | $1.42 \times 10^{-3}$ |
| Cyan coupler C-1 | 0.54 |
| Solvent-2 | 0.27 |
| Gelatin | 0.86 |
| Fourth Layer: Fast Red Sensitive Layer | |
| Silver iodobromide emulsion | 0.65 (as silver) |
| Red sensitizing dyes | $1.05 \times 10^{-3}$ |
| Cyan coupler C-1 | 0.97 |
| Solvent-2 | 0.49 |
| Gelatin | 1.51 |
| Fifth Layer: Intermediate Layer | |
| Dye-1 | 0.06 |
| Gelatin | 0.61 |
| Sixth Layer: Slow Green Sensitive Layer | |
| Silver iodobromide emulsion | 0.32 (as silver) |
| Green sensitizing dyes | $2.0 \times 10^{-3}$ |
| Coupler #1 | 0.50 |
| Solvent-1 | 0.25 |
| Gelatin | 0.86 |
| Seventh Layer: Fast Green Sensitive Layer | |
| Silver iodobomide emulsion | 0.54 (as silver) |
| Green sensitizing dyes | $1.0 \times 10^{-3}$ |
| Coupler #1 | 0.97 |
| Solvent-1 | 0.49 |
| Gelatin | 1.51 |
| Eighth Layer: Yellow Filter Layer | |
| Dye-2 | 0.27 |
| Gelatin | 0.61 |
| Ninth Layer: Slow Blue Sensitive Layer | |
| Silver iodobromide emulsion | 0.22 (as silver) |
| Blue Sensitizing dye | $1.08 \times 10^{-3}$ |
| Coupler Y-1 | 0.70 |
| Solvent-2 | 0.23 |
| Gelatin | 1.08 |
| Tenth Layer: Fast Blue Sensitive Layer | |
| Silver iodobromide emulsion | 0.54 (as silver) |
| Blue sensitizing dye | $1.60 \times 10^{-3}$ |
| Coupler Y-1 | 1.56 |
| Solvent-2 | 0.52 |
| Gelatin | 2.37 |
| Eleventh Layer: First Protective Layer | |
| Ultraviolet Absorbing Dyes | 0.51 |
| Gelatin | 1.40 |
| Twelfth Layer: Second Protective Layer | |
| Fine grain silver bromide emulsion | 0.12 (as silver) |
| Matte | 0.02 |
| Bis(vinylsulfonylmethane) | 0.26 |
| Gelatin | 0.97 |

-continued

| | |
|---|---|
| Solvent-1 | tritolyl phosphates |
| Solvent-2 | dibutylphthalate |

The resulting photographic element was exposed through a step wedge to actinic radiation and processed in the E-6 process. A retouching solution was prepared by mixing 23.1 g of a 30 percent by weight solution of hydrogen peroxide, 20 cc of a carbonate buffer having an ionic strength of 0.375 and a pH of 10, 50 cc of 3A alcohol, and diluting with water to make a volume of 100 cc. A 1 cm sample of the maximum density area of the multilayer color film was suspended in this retouching solution for 7 minutes while gently stirring. After rinsing and drying the Status A density was read. Table 3 lists the red green and blue densities of the sample before and after treatment with the retouching solution. It can be seen that the treatment removes 53 percent of the green density while the red and blue densities are reduced by only 10–12 percent. This demonstrates the very desirable feature of selectivity (i.e., bleaching one image dye without significantly affecting the other image dyes) of the invention.

TABLE 3

| Status A Density | Red | Green | Blue |
|---|---|---|---|
| Before Retouching | 2.93 | 3.65 | 3.14 |
| After Retouching | 2.64 | 1.92 | 2.76 |
| Percent Change | −10 | −53 | −12 |

The compounds used in the above film element, which are not described elsewhere in this specification, are as follows:

Cyan Coupler C-1

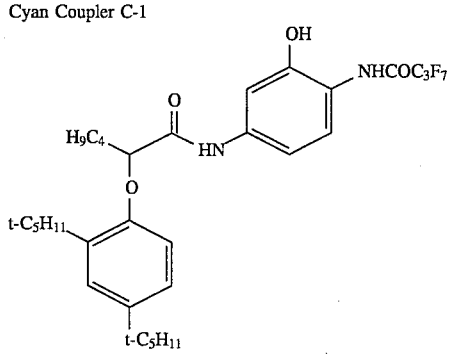

Yellow Coupler Y-1

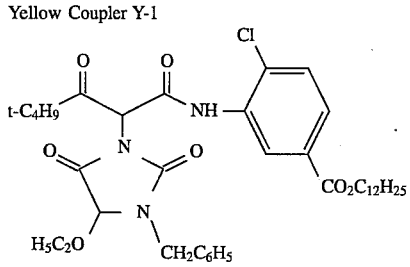

Dye-1

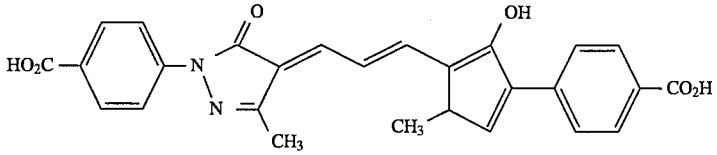

Dye-2

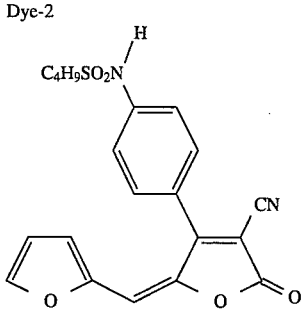

This invention has been described in detail with particular reference to preferred embodiments thereof. It will be understood that variations and modifications can be made within the spirit and scope of the invention.

What is claimed is:

1. A light sensitive reversal photographic element comprising a support bearing a silver halide emulsion associated with a pyrazoloazole magenta dye-forming coupler having the structure:

$$\text{Bal-P}_1 \qquad \text{I.}$$

where:

$P_1$ is a pyrazoloazole dye forming coupler moiety, and

Bal is an organic ballast group a) which is attached to the coupler at a position other than the coupling position, b) which immobilizes the coupler and the dye formed from the coupler on color development, c) which is not cleavable from the coupler by reversal color photographic processing, but d) which is cleavable from the dye by reaction with a dinucleophile to thereby render the dye mobile.

2. A light sensitive reversal photographic element comprising a support bearing a silver halide emulsion associated with a pyrazoloazole magenta dye-forming coupler having the structure:

$$\text{Bal-P}_1 \qquad \text{I.}$$

where:

$P_1$ is a pyrazoloazole dye forming coupler moiety, and

Bal is an organic ballast group a) which is attached to the coupler at a position other than the coupling position, b) which immobilizes the coupler and the dye formed from the coupler on color development, c) which is not cleavable from the coupler by reversal color photographic processing, but d) which is cleavable from the dye by reaction with a dinucleophile to thereby render the dye mobile;

wherein Bal has a structure selected from:

$$\text{BAL}'-(E_1)_u-(Y_1)_v-E_2-(T_1)_w-(T_2)_x-(L)_y- \qquad \text{II.}$$

$$\text{BAL}'-(T_2)_x-(T_1)_w-(E_1)_u-(Y_1)_v-E_2-(L)_y- \qquad \text{III.}$$

$$\text{BAL}'-(E_1)_u-(Y_1)_v-E_2-\underset{\underset{(\text{BAL}')_x-(T_2)_x}{|}}{(T_1)_w}-(L)_y- \qquad \text{IV.}$$

wherein:

BAL' is an organic group that provides sufficient bulk with the remainder of the molecule to maintain the coupler in the layer in which it is coated;

$E_1$ and $E_2$ are independently electrophilic groups;

$T_1$ and $T_2$ are individually releasable timing groups;

$Y_1$ is an atom or group that provides a distance between $E_1$ and $E_2$ that permits a nucleophilic displacement reaction to occur;

L is linking group comprising an alkyl, aryl, alkaryl or heterocyclyl group that links the coupler moiety to the remainder of the molecule;

one of BAL', $T_1$, $T_2$, L or $P_1$ contains a sulfur, nitrogen or oxygen atom through which it is bonded to $E_1$ or $E_2$;

u, v, w, x and y are each 0 or 1;

if u is 1, v is 1 and if u is 0, v is 0; and when u is 0, the group cleaved from $E_2$ has a $pK_a$ of 12 or less, and when u is 1, the group cleaved from $E_1$ or $E_2$ has a $pK_a$ of 16 or less.

3. A light sensitive reversal photographic element comprising a support bearing a silver halide emulsion associated with a pyrazoloazole magenta dye-forming coupler having a carbonyl or dicarbonyl electrophile, the coupler having sufficient bulk to remain in the layer in which it is coated and having a structure selected from:

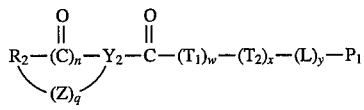

V

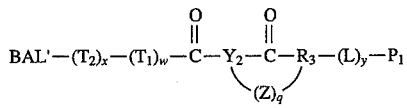

VI wherein:

y, n, q, x and w are 0 or 1;

when n is 0, q is 0;

$P_1$ is a pyrazoloazole coupler moiety;

$R_2$ is hydrogen, alkyl, aryl, or the atoms that together with Z and $Y_2$ complete a ring;

$R_3$ is alkylene, arylene, or the atoms that together with Z and $Y_2$ complete a ring;

Z represents the atoms necessary to complete a ring with $R_2$ or $R_3$ and $Y_2$;

$Y_2$ is a carbon or nitrogen atom in a group that, when n is 1, provides a distance between the ketone groups that enables a nucleophilic displacement reaction to occur;

BAL' is an organic group that provides sufficient bulk with the remainder of the molecule to maintain the coupler in the layer in which it is coated;

$T_1$ and $T_2$ are individually releasable timing groups;

L is linking group comprising an alkyl, aryl, alkaryl or heterocyclyl group that links the coupler moiety to the remainder of the molecule; and one of BAL', $T_1$, $T_2$, L or $P_1$ contains a sulfur, nitrogen or oxygen atom through which it is bonded to the adjacent carbonyl group.

4. A light sensitive reversal photographic element of claim 3, wherein the coupler has a structure selected from:

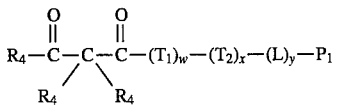

VII

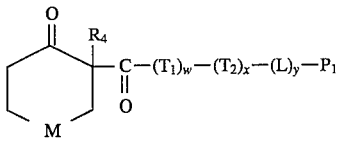

VIII

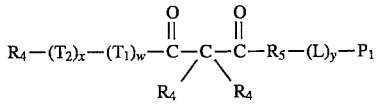

IX and

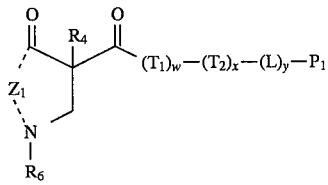

X wherein:

each $R_4$ individually is alkyl or aryl;

$R_5$ is alkylene or arylene;

$R_6$ is hydrogen, $COR_7$, $CO_2R_7$, $SO_2R_7$, $P(O)(OR_7)_2$, alkyl, or aryl;

$R_7$ is hydrogen, alkyl, aryl, or $NR_8R_9$;

$R_8$ and $R_9$ individually are hydrogen, alkyl, or aryl;

$Z_1$ represents the atoms to complete a 5-, 6- or 7-membered heterocyclic ring or fused ring system;

M is $—CH_2—$, —O—, or $—S(O)_q—$ where q is 0, 1 or 2;

w, x, and y are independently 0 or 1.

5. A light sensitive reversal photographic element of claim 3, wherein $P_1$ is selected from:

1H-pyrazolo[2,3-c]-s-triazoles, 1H-pyrazolo[2,3-b]-1,2,4-triazoles, 1H-pyrazolo[5,1-c]-1,2,4-triazoles, 1H-imidazo[1,2-b]pyrazoles, 1H-pyrazolo[1,5-d]tetrazoles, and 1H-pyrazolo[1,5-b]-1,2,4-triazoles.

6. A light sensitive reversal photographic element of claim 3, wherein $P_1$ is a 1H-pyrazolo[5,1-c]-1,2,4-triazole or a 1H-pyrazolo[1,5-b]-1,2,4-triazole.

7. A light sensitive reversal photographic element of claim 1, wherein the coupler has a structure selected from:

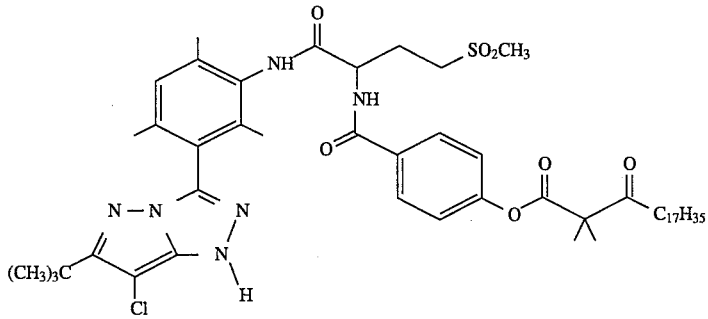

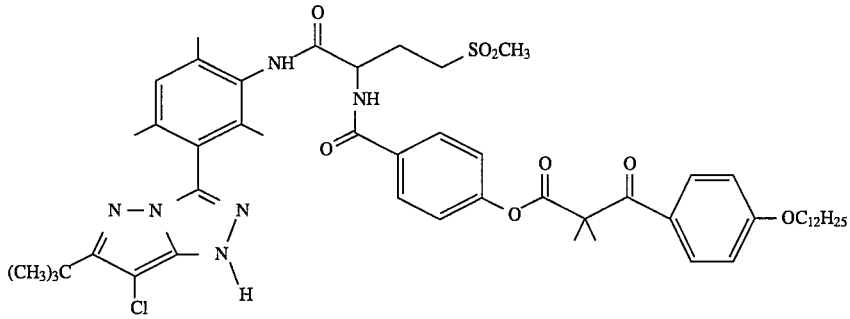

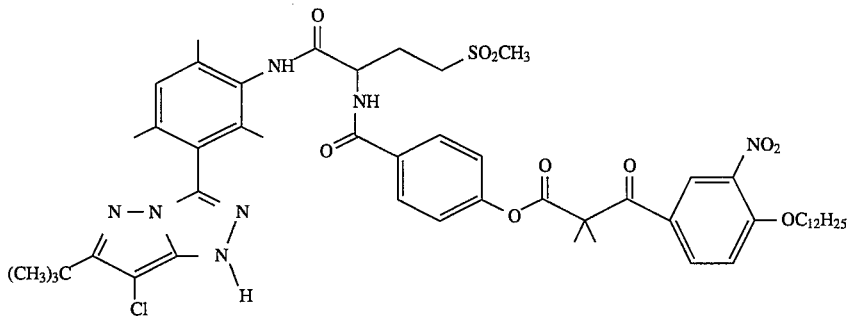

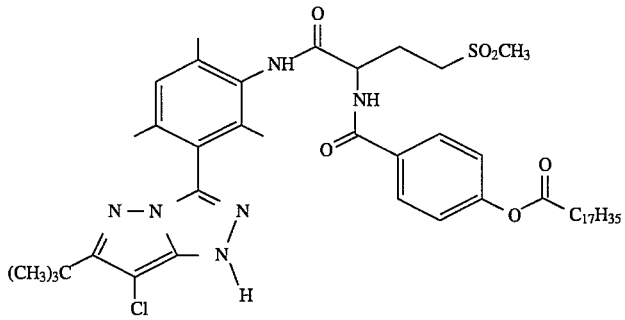

-continued
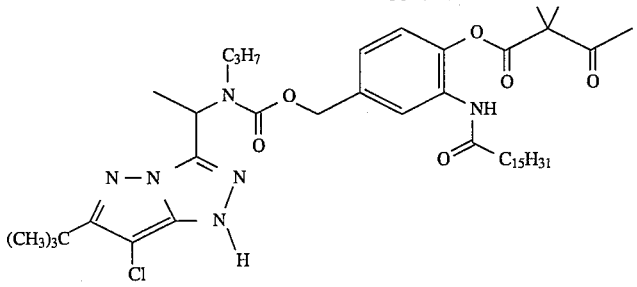
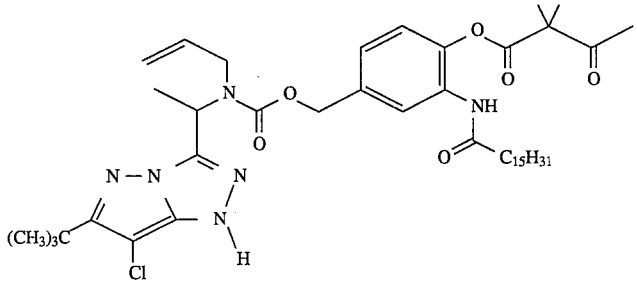
* * * * *